US011013351B2

(12) United States Patent
Mao et al.

(10) Patent No.: US 11,013,351 B2
(45) Date of Patent: May 25, 2021

(54) SEWING METHOD AND STRUCTURE FOR DUVET

(71) Applicant: Zhejiang Samsung Down Co., Ltd., Hangzhou (CN)

(72) Inventors: Fengwei Mao, Hangzhou (CN); Dasheng Du, Hangzhou (CN); Zhiliang Zhu, Hangzhou (CN); Zhengxiang Zhu, Hangzhou (CN); Xifeng Zhu, Hangzhou (CN)

(73) Assignee: Zhejiang Samsung Down Co., Ltd., Hangzhou (CN)

( * ) Notice: Subject to any disclaimer, the term of this patent is extended or adjusted under 35 U.S.C. 154(b) by 310 days.

(21) Appl. No.: 16/192,503

(22) Filed: Nov. 15, 2018

(65) Prior Publication Data

US 2019/0191896 A1 Jun. 27, 2019

(30) Foreign Application Priority Data

Dec. 27, 2017 (CN) ..... 201711444768.8

(51) Int. Cl.

| | |
|---|---|
| ***A47G 9/02*** | (2006.01) |
| ***D05B 11/00*** | (2006.01) |
| ***D05C 17/00*** | (2006.01) |

(52) U.S. Cl.

CPC ..... *A47G 9/0207* (2013.01); *D05B 11/00* (2013.01); *D05C 17/00* (2013.01); *D10B 2503/06* (2013.01)

(58) Field of Classification Search

CPC ..... A47G 9/02; A47G 9/0207; D05B 11/00; D05C 17/00; D10B 2503/06

See application file for complete search history.

(56) References Cited

U.S. PATENT DOCUMENTS 4,115,610 A * 9/1978 Wortman ..... A47G 9/0207 112/420

2007/0202763 A1* 8/2007 Shibaoka ..... A45B 25/18 442/203

* cited by examiner

*Primary Examiner* — Fredrick C Conley

(74) *Attorney, Agent, or Firm* — Schwegman Lundberg & Woessner, P.A.

(57) ABSTRACT

This application provides a sewing method and structure for a duvet, and the sewing method includes the following steps: first, stacking base cloth, a plurality pieces of retractable cloth and a plurality pieces of connection cloth together in sequence to form a duvet unit; then aligning two duvet units, and sewing the connection cloth on the two duvet units together in a one-to-one correspondence; and finally sewing perimeters of two pieces of the base cloth together in a one-to-one correspondence to form a closed down space. A beneficial effect of this invention is that downs in the duvet cannot run out from the gaps.

9 Claims, 2 Drawing Sheets

SEWING METHOD AND STRUCTURE FOR DUVET

CROSS-REFERENCE TO RELATED APPLICATIONS

This Non-provisional application claims priority under 35 U.S.C. § 119(a) on Patent Chinese Application No(s). 201711444768.8 on Dec. 27, 2017, the entire contents of which are hereby incorporated by reference.

BACKGROUND OF THE INVENTION

Field of the Invention

This invention relates to a duvet field and, more particularly, to a sewing method and a structure of a duvet.

Description of the Related Art

A duvet is welcomed by people because of its good thermal insulation effect and light weight. Existing duvets generally adopt the following structures: two pieces of cloth are sewn together to form a plurality of intercommunicated down filling spaces, and down is filled in these down filling spaces. Because the duvet is completely fitted to human body, the cloth used for the duvet is usually cotton cloth, silk cloth, polyester cloth, silk cotton interwoven cloth, or polyester cotton interwoven cloth. During a sewing process, a needle passes through fabric and leaves a pinhole, and the diameter of the pinhole is equal to the diameter of the needle, but the diameter of a thread is much smaller than the diameter of the pinhole. While stretch properties of the cotton and the silk are very poor (nearly unable to shrink), so the needle pokes a hole at these fabrics, and yarns of the fabrics may be cut off. This hole will almost never change, and it will gradually become bigger as time goes on, leaving a gap between the pinhole and the thread, while relatively small down fiber will run out from this gap (i.e. people often say "duvet running")

BRIEF SUMMARY OF THE INVENTION

Aiming at solving the above-mentioned problems, this invention provides a sewing method and structure of a duvet.

The technical solution of this invention is as follows:

the sewing method for the duvet includes the following steps:

first, stacking the base cloth, a plurality pieces of retractable cloth and a plurality pieces of connection cloth together in sequence to form a duvet unit;

then aligning two duvet units, and sewing the connection cloth on the two duvet units together in a one-to-one correspondence; and finally sewing perimeters of two pieces of the base cloth together in a one-to-one correspondence to form a closed down space.

In the above-mentioned method, two duvet surfaces of the duvet (that is, the base cloth mentioned above) are not directly sewn together, but are connected together by two pieces of the connection cloth, while one piece of the retractable cloth is disposed between each piece of the connection cloth and each piece of the base cloth. For the retractable cloth, raw materials and treatment agents are finely selected in a series of processes such as spinning, printing and dyeing, and post finishing, such that a thread will not be broken but will be squeezed out when the retractable cloth is needled. After a needle is pulled away, the fabric has an ability of automatically retract a pinhole until the pinhole completely disappears. Therefore the needle pokes a hole at the fabric, and the hole slowly becomes smaller until it disappears. One piece of the retractable cloth is disposed between the connection cloth and the base cloth. After the thread sews the three together, the small hole on the base cloth will not disappear. However, the small hole is tightly attached to a piece of retractable cloth, while the retractable cloth will wholly block the small hole to ensure that down cannot run out from the small hole. At the same time, two pieces of the base cloth are connected by the connection cloth, so when people pull two fabrics of the duvet (that is, the base cloth in this application), force will not be transmitted to the retractable cloth, which will ensure that the retractable cloth will not be torn up, and no gap will occur between the small hole on the base cloth and the retractable cloth. When all the mutually paired pieces of the connection cloth are sewn together, a plurality of mutually independent down filling spaces are formed between two pieces of the base cloth, in order to ensure that there is a passage between these mutual independent down filling spaces. Specifically, during a sewing process, part of two pieces of the connection cloth which are paired with each other is sewn together, part of them is not sewed together to form one passage, and a down filling machine uses this passage to fill the duvet with down.

In the above-mentioned solution, gap between the duvet surface (base cloth) and the thread is blocked by nylon cloth, and down in the duvet cannot run out from the gap between the duvet surface (base cloth) and the thread.

Optionally, the mentioned two pieces of the base cloth may be folded along themselves to a double-layer structure, and then perimeters of two pieces of the base cloth may be aligned and sewn together.

Each perimeter of two pieces of the base cloth is folded and then sewn together (i.e., piping) such that there is no down left at edges of four sides of the duvet, and there is no need to worry that down run out from the gap between the base cloth and the thread. Specifically, when four edges are sewn, three edges of the four edges are sewn together, and the left edge is not sewn with a down filling hole of between 6 cm to 12 cm. After the down filling machine completes down filling operation, the down filling hole of the last edge is sewn together.

Optionally, two pieces of the connection cloth on two pieces of the base cloth are connected to separate the down space into a plurality of independent down filling spaces.

Optionally, down filling passages are arranged between adjacent down filling spaces.

This invention further provides a structure of a duvet including two duvet units, and each of the duvet units includes base cloth, a plurality of retractable cloth, a plurality of connection cloth sequentially stacked and sewn together, and a closed down space formed by sewing perimeters of two pieces of the base cloth together.

Optionally, the structure of the duvet further includes a plurality of independent down filling spaces formed by connecting two pieces of the connection cloth on two pieces of the base cloth together to separate the down space and down filling passages arranged between adjacent down filling spaces.

After two pieces of the base cloth are aligned, the connection cloth on each base cloth are sewn. Due to the need of forming a plurality of down filling spaces, in order to prevent the down "getting together" in the down filling space, the volume of the down filling space should not be too large, so a plurality pieces of connection cloth are disposed on the base cloth. A specific disposing method is to dispose a criss-cross type, and at the same time, in order to facilitate sewing work, the connection cloth disposed vertically is perpendicular to the connection cloth disposed horizontally. Since the down filling passage needs to be left between adjacent down filling spaces, while only one down filling passage needs to be left to meet requirements of the down filling operation of the down filling machine, in the specific sewing, all the vertical connection cloth that are paired up and down are sewn together. When two pieces of horizontally paired connection cloth are sewn, sew one section at intervals, such that there is a sewing gap between the upper and lower two pieces of the connection cloth, and this sewing gap is used as the down filling passage. Taking into account the size of majority of the down filling machines, the length of the sewing gap is controlled within a range of 3 cm to 10 cm.

Optionally, the connection cloth may be arranged in a "田" shape or a diamond shape on the base cloth, and down filling passages may be arranged in straight lines.

The connection cloth can be arranged as an arbitrary shape on the base cloth, but considering the convenience of the down filling operation of the down filling machine, the "田" shape or the diamond shape is preferred, such that the down filling passages are arranged in straight lines, which is convenient for the down filling operation of the down filling machine.

Optionally, the connection cloth may be knitted warp knitting cloth.

The warp knitting cloth is cheap and high in strength, and air flows that are mutually circulated can be formed in adjacent down filling spaces since the warp knitting cloth is porous cloth. For example, if the flowing air flow cannot be formed in each down filling space, when down in one of the down filling spaces are excessive humid, moisture in this down filling space can only be diffused out through upper and lower surfaces, in this way, since a diffusion area is relatively small, and a diffusion speed is relatively low, the whole duvet cannot maintain the same in thermal insulation and humidity in each area; however, since the air flow in each down filling space can flow mutually, the moisture in this down filling space can diffuse into around down filling spaces and diffuse out of these down filling spaces, since the diffusion area is enlarged, and the diffusion speed is faster, dryness of the duvet is guaranteed. At the same time, because the air flow in each down filling space can be circulated, the whole duvet can be guaranteed to have a uniform temperature, a uniform humidity, and a better thermal insulation effect.

Optionally, the base cloth may be cotton cloth, silk cloth, polyester cloth, silk cotton interwoven cloth, or polyester cotton interwoven cloth.

Any fabric with high count & high density and down-proof effect can be used as the base cloth. However, since the base cloth is in direct contact with human skin, cotton cloth, silk cloth, polyester cloth, silk cotton interwoven cloth, and polyester cotton interwoven cloth with good affinity to human body are preferred.

Optionally, the retractable cloth may be retractable nylon cloth or retractable polyester cloth; and a warp and weft density of the retractable nylon cloth or the retractable polyester cloth may be not less than 280 T.

In this solution, for the retractable nylon cloth (or the retractable polyester cloth), raw materials and treatment agents are finely selected in a series of processes such as spinning, printing and dyeing, and post finishing, such that the thread will not be broken but will be squeezed out when the retractable nylon cloth is needled. After the needle is pulled away, the fabric has the ability of automatically retract the pinhole until the pinhole completely disappears. Only when the retractable nylon cloth (or the retractable polyester cloth) has a warp and weft density of more than 280 T, the retractable nylon cloth does not leave a pinhole after the needle passes through. The retraction nylon fabric (or the retractable polyester cloth) with a warp and weft density of 380 T is preferred with consideration of the price and a retractable performance of the fabric.

Beneficial effects of this invention are: a retractability of the retractable nylon cloth (or the retractable polyester cloth) is fully utilized such that the gap between the duvet surface of the duvet (base cloth) and the thread is blocked by the retractable nylon cloth (or the retractable polyester cloth), which ensures that down in the duvet cannot run out from this gap; at the same time, heat transfer and ventilation of interior of the duvet are good which ensure that the duvet is thy, the internal temperature is uniform, and the thermal insulation effect is good.

Figure reference numbers: 1 base cloth, 2 retractable cloth, 3 connection cloth, 4 down filling passage, and 5 thread.

DETAILED DESCRIPTION OF THE INVENTION

This invention is described in detail with reference to the accompanying drawings.

Figure 1:
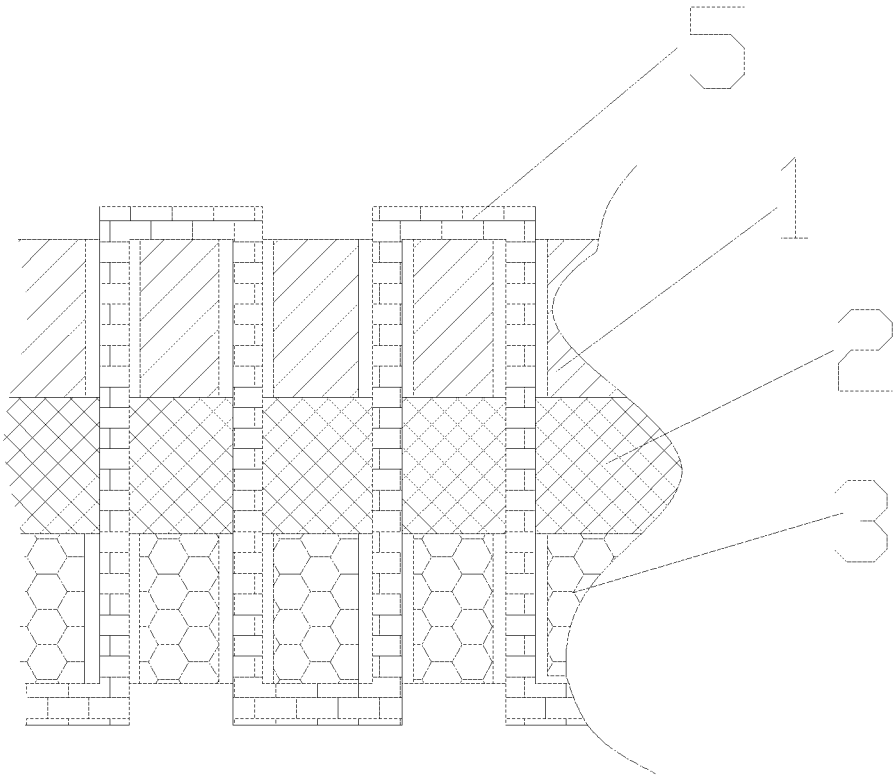
FIG. 1 is a schematic diagram of a sewing structure of three parts: base cloth, retractable cloth and connection cloth.
Figure 2:
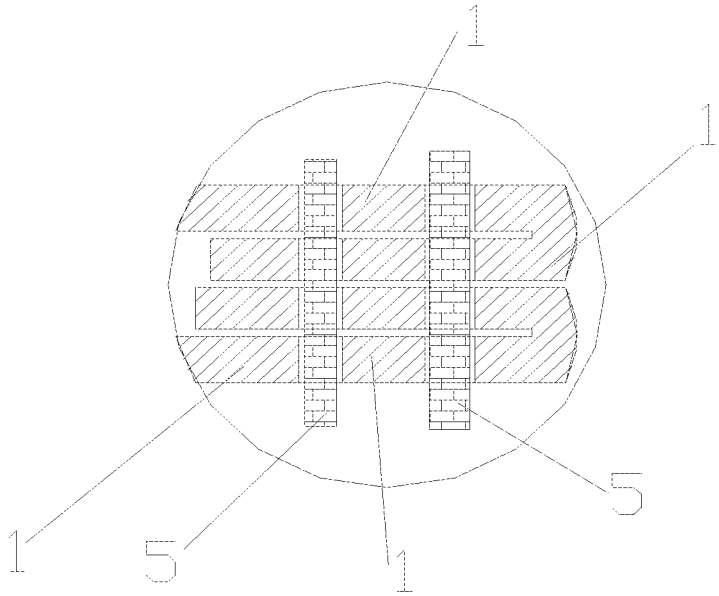
FIG. 2 is a schematic diagram of a sewing structure between two pieces of the base cloth.
Figure 3:
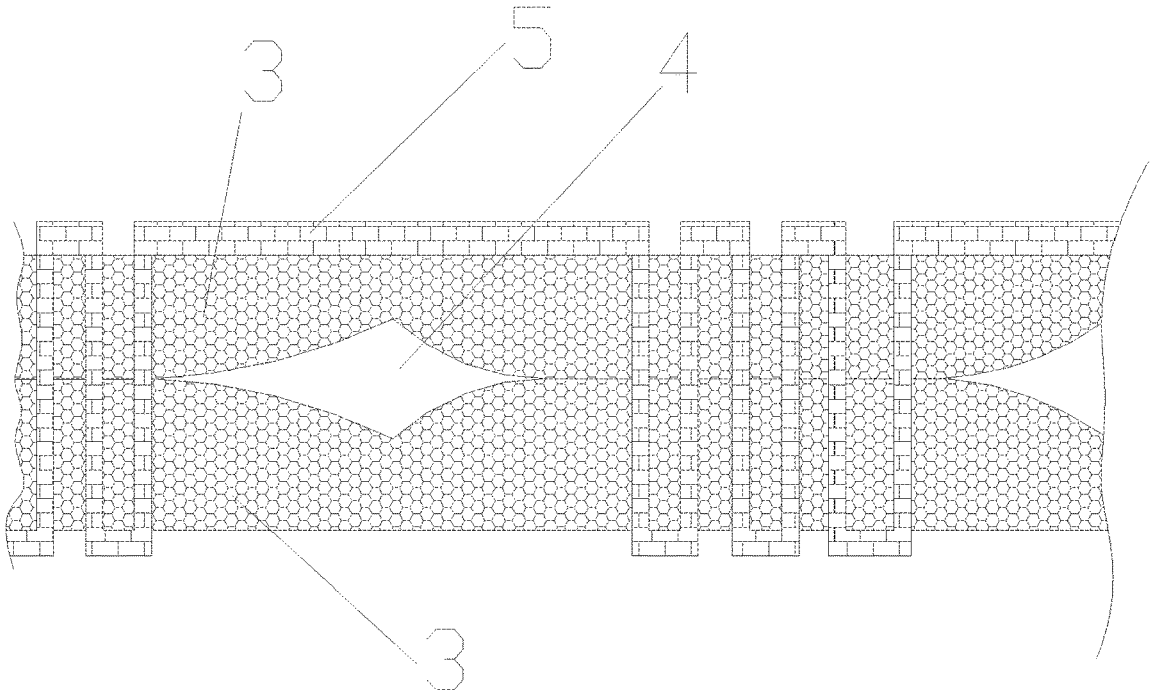
FIG. 3 is a schematic diagram of a sewing structure of two pieces of the connection cloth.
Figure 4:
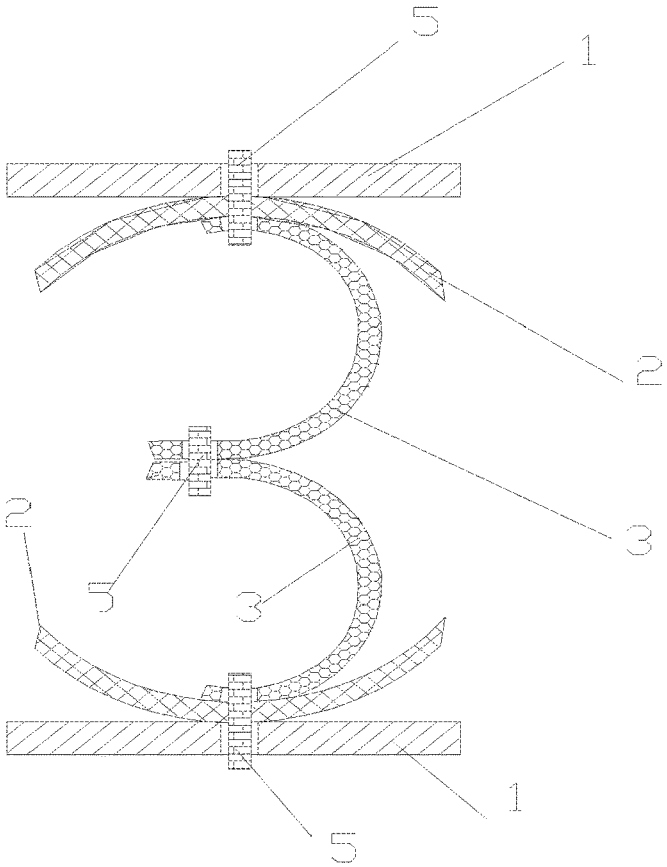
FIG. 4 is a sewing structure of an interior of a duvet.

As shown in FIG. 1, FIG. 2, FIG. 3 and FIG. 4, a sewing method for a duvet includes the following steps: first, stacking base cloth 1, a plurality pieces of retractable cloth 2 and a plurality pieces of connection cloth 3 together in sequence to form a duvet unit; then aligning two duvet units, and sewing the connection cloth 3 on the two duvet units together in a one-to-one correspondence; and finally sewing perimeters of two pieces of the base cloth 1 together in a one-to-one correspondence.

In the above-mentioned structure, two duvet surfaces of the duvet (that is, the base cloth 1 mentioned above) are not directly sewn together, but are connected together by two pieces of the connection cloth, while one piece of the retractable cloth 2 is disposed between each piece of the connection cloth and each piece of the base cloth 1. For the retractable cloth 2, raw materials and treatment agents are finely selected in a series of processes such as spinning, printing and dyeing, and post finishing, such that a thread 5 will not be broken but will be squeezed out when the retractable cloth 2 is needled. After a needle is pulled away, the fabric has an ability of automatically retract a pinhole until the pinhole completely disappears. Therefore the needle pokes a hole at the fabric, and the hole slowly becomes smaller until it disappears. One piece of the retractable cloth 2 is disposed between the connection cloth 3 and the base cloth 1. After the thread 5 sews the three together, the small hole on the base cloth 1 will not disappear. However, the small hole is tightly attached to a piece of retractable cloth 2, while the retractable cloth 2 will wholly block the small hole to ensure that down cannot run out from the small hole. At the same time, two pieces of the base cloth 1 are connected by the connection cloth 3, so when people pull two fabrics of the duvet (that is, the base cloth 1 in this application), force will not be transmitted to the retractable cloth 2, which will ensure that the retractable cloth 2 will not be tom up, and no gap will occur between the small hole on the base cloth 1 and the retractable cloth 2. When all the mutually paired pieces of the connection cloth 3 are sewn together, a plurality of mutually independent down filling spaces are formed between two pieces of the base cloth 1, in order to ensure that there is a passage between these mutual independent down filling spaces. Specifically, during a sewing process, part of two pieces of the connection cloth 3 which are paired with each other is sewn together, part of them is not sewed together to form one passage, and a down filling machine uses this passage to fill the duvet with downs.

In the above-mentioned solution, gap between the duvet surface of the duvet (base cloth 1) and the thread 5 is blocked by nylon cloth, and down in the duvet cannot run out from the gap between the duvet surface (base cloth 1) and the thread 5.

As shown in FIG. 1, FIG. 2, FIG. 3 and FIG. 4, the connection cloth 3 is knitted warp knitting cloth.

The warp knitting cloth is cheap and high in strength, and air flows that are mutually circulated can be formed in adjacent down filling spaces since the warp knitting cloth is porous cloth. For example, if the flowing air flow cannot be formed in each down filling space, when down in one of the down filling spaces are excessive humid, moisture in this down filling space can only be diffused out through upper and lower surfaces, in this way, since a diffusion area is relatively small, and a diffusion speed is relatively small, the whole duvet cannot maintain the same in thermal insulation and humidity in each area; however, since the air flow in each down filling space can flow mutually, the moisture in this down filling space can diffuse into surrounding down filling spaces and diffuse out of these down filling spaces, since the diffusion area is enlarged, and the diffusion speed is faster, dryness of the duvet is guaranteed. At the same time, because the air flow in each down filling space can be circulated, the whole duvet can be guaranteed to have a uniform temperature, a uniform humidity, and a better thermal insulation effect.

As shown in FIG. 1, FIG. 2, FIG. 3 and FIG. 4, the base cloth 1 is cotton cloth or silk cloth or polyester cloth or silk cotton interwoven cloth or polyester cotton interwoven cloth.

Any fabric with high count & high density and down-proof effect can be used as the base cloth 1. However, since the base cloth 1 is in direct contact with human skin, cotton cloth, silk cloth, polyester cloth, silk cotton interwoven cloth, and polyester cotton interwoven cloth with good affinity to human body are preferred.

As shown in FIG. 1, FIG. 2, FIG. 3 and FIG. 4, the retractable cloth 2 is retractable nylon cloth or retractable polyester cloth; and a warp and weft density of the retractable nylon cloth or the retractable polyester cloth is not less than 280 T.

In this solution, for the retractable nylon cloth (or the retractable polyester cloth), raw materials and treatment agents are finely selected in a series of processes such as spinning, printing and dyeing, and post finishing, such that the thread 5 will not be broken but will be squeezed out when the retractable nylon cloth is needled. After the needle is pulled away, the fabric has the ability of automatically retract the pinhole until the pinhole completely disappears. Only when the retractable nylon cloth (or the retractable polyester cloth) has a warp and weft density of more than 280 T, the retractable nylon cloth does not leave a pinhole after the needle passes through. The retraction nylon fabric (or the retractable polyester cloth) with a warp and weft density of 380 T is preferred with consideration of the price and a retractable performance of the fabric.

As shown in FIG. 1, FIG. 2, FIG. 3 and FIG. 4, first, perimeters of two pieces of the base cloth 1 are folded along themselves to a double-layer structure, and then perimeters of two pieces of the base cloth 1 are aligned and sewn together.

Each perimeter of two pieces of the base cloth 1 is folded and then sewn together (i.e., piping) such that there is no down left at edges of four sides of the duvet, and there is no need to worry that down run out from the gap between the base cloth 1 and the thread 5. Specifically, when four edges are sewn, first three edges of the four edges are sewn together, and the left edge is not sewn with a down filling hole of between 6 cm to 12 cm left. After the down filling machine completes down filling operation, the down filling hole of the last edge is sewn together.

A structure of a duvet includes two duvet units, and the duvet unit includes base cloth 1, retractable cloth 2 and connection cloth 3 which are sequentially stacked and sewn together; perimeters of two pieces of the base cloth 1 are sewn together to form a closed down space; and two pieces of the connection cloth 3 on two pieces of the base cloth 1 are connected to separate the down space into a plurality of independent down filling spaces, and a down filling passage 4 is left between adjacent down filling spaces.

After two pieces of the base cloth 1 are aligned, the connection cloth 3 on each base cloth 1 are sewn. Due to the need of forming a plurality of down filling spaces, in order to prevent the down "getting together" in the down filling space, the volume of the down filling space should not be too large, so a plurality pieces of connection cloth 3 are disposed on the base cloth 1. A specific disposing method is to dispose a criss-cross type, and at the same time, in order to facilitate sewing work, the connection cloth 3 disposed vertically is perpendicular to the connection cloth 3 disposed horizontally. Since the down filling passage 4 needs to be left between adjacent down filling spaces, while only one down filling passage 4 needs to be left to meet requirements of the down filling operation of the down filling machine, in the specific sewing, all the vertical connection cloth 3 that are paired up and down are sewn together. When two pieces of horizontally paired connection cloth 3 are sewn, sew one section at intervals, such that there is a sewing gap between the upper and lower two pieces of the connection cloth 3, and this sewing gap is used as the down filling passage 4. Taking into account the size of majority of the down filling machines, the length of the sewing gap is controlled within a range of 3 cm to 10 cm.

As shown in FIG. 1, FIG. 2, FIG. 3 and FIG. 4, the connection cloth 3 is arranged in a "田" shape or a diamond shape on the base cloth 1, and down filling passages 4 are arranged in straight lines.

The connection cloth 3 can be arranged as an arbitrary shape on the base cloth 1, but considering the convenience of the down filling operation of the down filling machine, the "田" shape or the diamond shape is preferred, such that the down filling passages 4 are arranged in straight lines, which is convenient for the down filling operation of the down filling machine.

Although the present invention has been described in considerable detail with reference to certain preferred embodiments thereof, the disclosure is not for limiting the scope of the invention. Persons having ordinary skill in the art may make various modifications and changes without departing from the scope and spirit of the invention. Therefore, the scope of the appended claims should not be limited to the description of the preferred embodiments described above.

What is claimed is:

1. A sewing method for a duvet comprising the following steps: first stacking and sewing a piece of base cloth for providing an outer duvet surface, a plurality of pieces of retractable cloth, and a plurality of pieces of connection cloth together in sequence to form a duvet unit, each piece of connection cloth being shaped as a strip and the connection cloth for connecting the duvet unit to a further duvet unit; then aligning two duvet units by mutually pairing the pieces of connection cloth of each duvet unit together, and sewing the connection cloth on the two duvet units together in a one-to-one correspondence to form a groove at a joint of the connection cloths, wherein, during the sewing of the connection cloths of the two duvet units, part of the two pieces of base cloth on the two duvet units is not sewn together to form a down filing passage; and finally sewing perimeters of two pieces of base cloth of each duvet unit together in a one-to-one correspondence to form a closed down space;

wherein a plurality of independent down filing spaces are formed by connecting the two pieces of connection cloth on two pieces of the base cloth together to separate the down space and the down filing passages arranged between adjacent down filling spaces; the down filling spaces being surrounded by two connecting cloths connected and the base cloth, and in that each piece of retractable cloth has the ability to automatically retract to close or substantially close a sewing pinhole.

2. The sewing method for the duvet according to claim 1, wherein the perimeters of each piece of base cloth of each duvet unit are first folded along themselves to be a double-layer structure, and then the perimeters of two pieces of the base cloth are aligned and sewn together.

3. The sewing method for the duvet according to claim 1, wherein two pieces of the connection cloth on two pieces of the base cloth are connected to separate the down space into a plurality of independent down filling spaces.

4. The sewing method for the duvet according to claim 1, wherein down filling passages are arranged between adjacent down filling spaces.

5. A structure of a duvet comprising: two duvet units, and each of the duvet units comprising a piece of base cloth for providing an outer duvet surface, a plurality of pieces of retractable cloth, and a plurality of pieces of connection cloth for connecting a first of the duvet units to the second of the duvet units, sequentially stacked and sewn together, and a closed down space formed by sewing perimeters of two pieces of the base cloth together; wherein the retractable cloth has the ability to automatically retract to close or substantially close a sewing pinhole.

6. The structure of the duvet according to claim 5, further comprising a plurality of independent down filling spaces formed by connecting two pieces of the connection cloth on two pieces of the base cloth together to separate the down space and down filling passages arranged between adjacent down filling spaces.

7. The structure of the duvet according to claim 5, wherein the retractable cloth is retractable nylon cloth or retractable polyester cloth; and a warp and weft density of the retractable nylon cloth or the retractable polyester cloth is no less than 280 T.

8. The structure of the duvet according to claim 5, wherein the connection cloth is knitted warp knitting cloth.

9. The structure of the duvet according to claim 5, wherein the base cloth is cotton cloth, silk cloth, polyester cloth, silk cotton interwoven cloth, or polyester cotton interwoven cloth.

* * * * *